US008007040B2

(12) United States Patent
Krueger

(10) Patent No.: US 8,007,040 B2
(45) Date of Patent: Aug. 30, 2011

(54) FURNITURE PIECE WITH A SUPPORT MEMBER AND RECESSED FASTENER

(75) Inventor: Todd D. Krueger, Lillington, NC (US)

(73) Assignee: Bob Barker Company, Inc., Fuquay-Varina, NC (US)

( * ) Notice: Subject to any disclaimer, the term of this patent is extended or adjusted under 35 U.S.C. 154(b) by 0 days.

(21) Appl. No.: 12/498,116

(22) Filed: Jul. 6, 2009

(65) Prior Publication Data

US 2011/0001339 A1 Jan. 6, 2011

(51) Int. Cl.
*A47B 39/00* (2006.01)
*A47B 83/02* (2006.01)
*A47C 7/02* (2006.01)

(52) U.S. Cl. ..... 297/157.1; 297/158.3; 297/158.5

(58) Field of Classification Search ..... 297/157.1, 297/158.3, 158.4, 158.5, 159.1, 440.22
See application file for complete search history.

(56) References Cited

U.S. PATENT DOCUMENTS

| | | | | | |
|---|---|---|---|---|---|
| 2,713,889 | A * | 7/1955 | White | 297/158.3 |
| 3,120,405 | A * | 2/1964 | Soszynski | 297/158.3 |
| 3,572,824 | A * | 3/1971 | Schupbach et al. | 297/158.5 |
| 4,052,100 | A * | 10/1977 | Nikitits et al. | 297/158.4 |
| 4,070,057 | A * | 1/1978 | Jones | 297/158.4 |
| 4,111,482 | A * | 9/1978 | Jones | 297/158.4 |
| 4,131,311 | A * | 12/1978 | Nikitits et al. | 297/158.4 |
| 4,223,945 | A * | 9/1980 | Nikitits | 297/158.4 X |
| 5,152,582 | A * | 10/1992 | Magnuson | 297/440.22 |
| 5,603,472 | A * | 2/1997 | Hutter, III | 244/132 |
| 5,720,512 | A * | 2/1998 | Hostetler | 297/158.5 |
| 5,782,526 | A * | 7/1998 | Ott | 297/157.1 |
| 5,921,622 | A * | 7/1999 | Newton | 297/157.1 |
| 6,010,185 | A * | 1/2000 | Petersen | 297/158.3 |
| 6,378,945 | B1 * | 4/2002 | Krueger | 297/440.22 |
| 6,749,265 | B1 * | 6/2004 | Wang | 297/440.22 X |
| 6,878,026 | B2 * | 4/2005 | Cloutier | 297/158.3 X |
| 6,883,864 | B2 * | 4/2005 | Gregory | 297/158.5 |
| 7,393,049 | B2 * | 7/2008 | Chase | 297/157.1 X |
| 7,758,113 | B2 * | 7/2010 | Hanusiak et al. | 297/159.1 |
| 2007/0290531 | A1 * | 12/2007 | Larsen et al. | 297/158.5 |

FOREIGN PATENT DOCUMENTS

DE 3223143 A1 * 12/1983

OTHER PUBLICATIONS

"Glass Mount Handrail Brackets." Product Information Sheet, 2 pages. The Wagner Companies, Milwaukee, WI. http://wagnercompanies.com/site/viewer.aspx?iid=1622&mname=article&rpid=542.

* cited by examiner

*Primary Examiner* — Rodney B White
(74) *Attorney, Agent, or Firm* — Coats & Bennett, P.L.L.C.

(57) ABSTRACT

A furniture piece that may include a support member with opposing first and second surfaces. A recess may extend into the first surface. The support member may also include a first aperture within the recess that extends through to the second surface. A brace may be positioned to support the support member. The brace may include a second aperture that aligns with the first aperture. A fastener that includes a head and an outwardly-extending neck may attach the support member and brace together. The head may seat within the recess and the neck may extend through the first and second apertures. One or more spacers may be positioned along the neck to position the head relative to the support member. A thickness of the head may be less than a depth of the recess such that a surface of the head is flush with the first surface of the support member or positioned within the recess below the first surface of the support member.

20 Claims, 6 Drawing Sheets

FURNITURE PIECE WITH A SUPPORT MEMBER AND RECESSED FASTENER

BACKGROUND

The present application is directed to a furniture piece, and more particularly, to a furniture piece with a fastener that connects a support member to a brace and is seated in a recess in the support member.

Furniture pieces such as tables and seats are used for a variety of different functions. Furniture pieces generally include a support member that includes a working surface. Seats generally include a support member that includes a seating surface to support the user. The furniture pieces also include one or more braces that are attached to for supporting and positioning the support members. Fasteners attach the support members to a brace in a manner for them to be used for the various functions.

The table working surface should be configured for the user to perform the various functions. This may include forming a surface to receive plates and utensils during eating, providing a support surface to support a book, newspaper, and a variety of other items, and providing a surface for writing or painting. Likewise, the seating surface should be configured to support the user while they are sitting. Often times the working surface and the seating surface are flat to facilitate these functions, although each may be contoured. The support members should be constructed such that the fasteners do not interfere with the various functions. Further, the fasteners should be configured to allow cleaning of the support members when necessary.

Furniture pieces used in correctional institutions, such as prisons and detention facilities, require additional safeguards. These safeguards include a construction that prevents taking the piece apart such that the support member, braces, or fasteners can be used as weapons. This may include fasteners constructed in a way that prevent removal from the support members. This may also include hiding or shielding the fasteners to prevent access by the users. Shielding or hiding prevents the user from manipulating the fasteners in a manner that they can be taken apart. Further, these safeguards should be accomplished without lessening the ability of the piece to be used for the various functions.

SUMMARY

The present application is directed to a furniture piece. The furniture piece may include a support member with opposing first and second surfaces. A recess may extend into the first surface. The support member may also include a first aperture within the recess that extends through to the second surface. A brace may be positioned to support the support member. The brace may include a second aperture that aligns with the first aperture. A fastener that includes a head and an outwardly-extending neck may attach the first and braces together. The head may seat within the recess and the neck may extend through the first and second apertures. One or more spacers may be positioned along the neck to position the head relative to the support member. A thickness of the head may be less than a depth of the recess such that a surface of the head is flush with the first surface of the support member or positioned within the recess below the first surface of the support member.

The various aspects of the various embodiments may be used alone or in any combination, as is desired.

DETAILED DESCRIPTION

Figure 1:
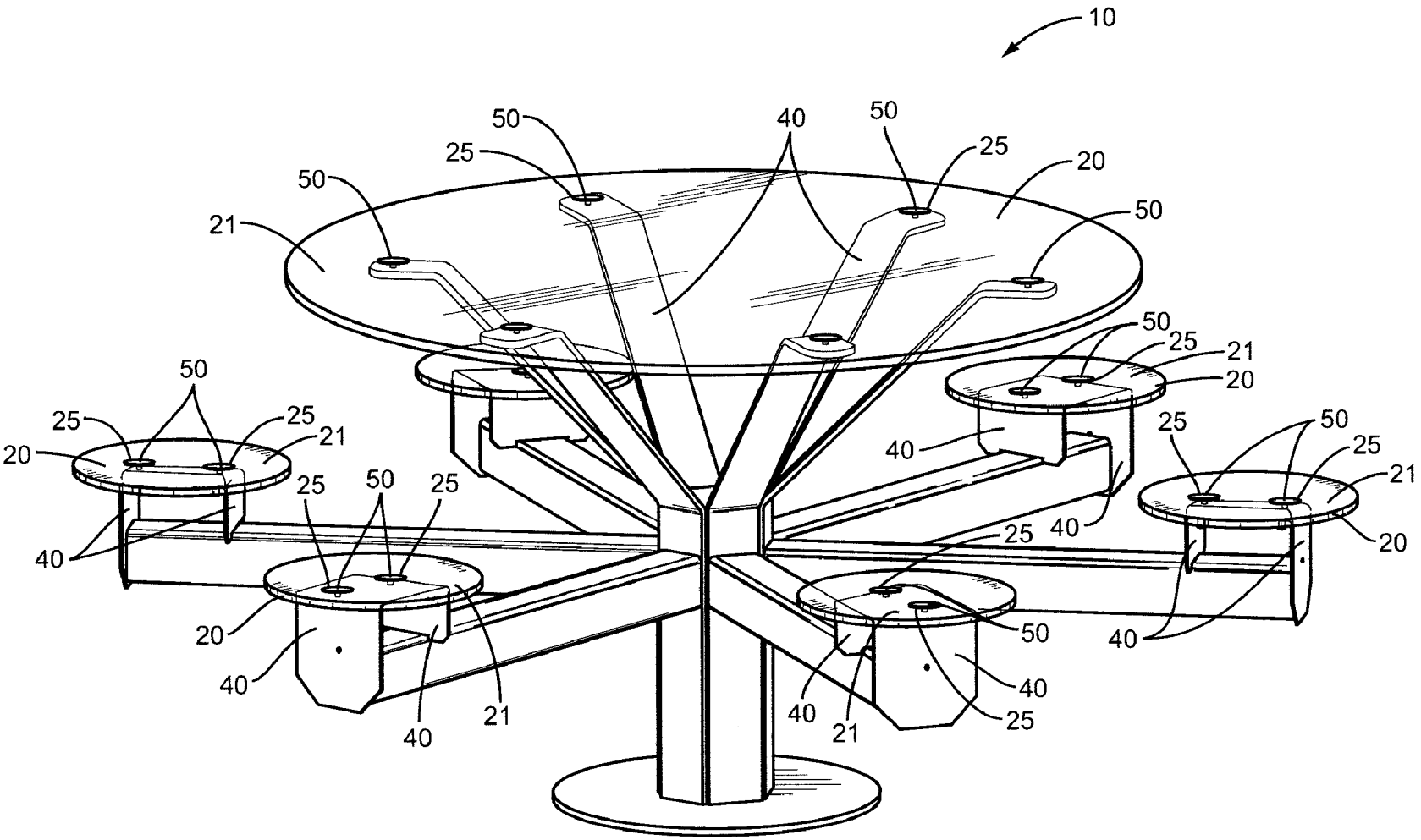
FIG. 1 is a perspective view of a furniture piece with recessed fasteners according to one embodiment.

The present application is directed to a furniture piece 10 for use in a variety of contexts. These may include home and office use, and use within a correctional institution. The furniture piece 10 generally includes a fastener 50 that attaches a support member 20 with a brace 40. The support member 20 includes a recess 25 that positions the fastener 50 flush with or below a top surface of the support member 20. This positioning allows the top surface 21 to be used for the various functions without interference by the fastener 50. The positioning may also prevent tampering with the fastener 50 and facilitate cleaning the furniture piece 10.

The furniture piece 10 may include but is not limited to a table, seat, and combinations of the two. The seat may include various forms including but not limited to a chair, bench, and a stool. The furniture piece 10 may include a variety of different sizes and shapes depending upon the desired functionality and aesthetic appearance.

Figure 2:
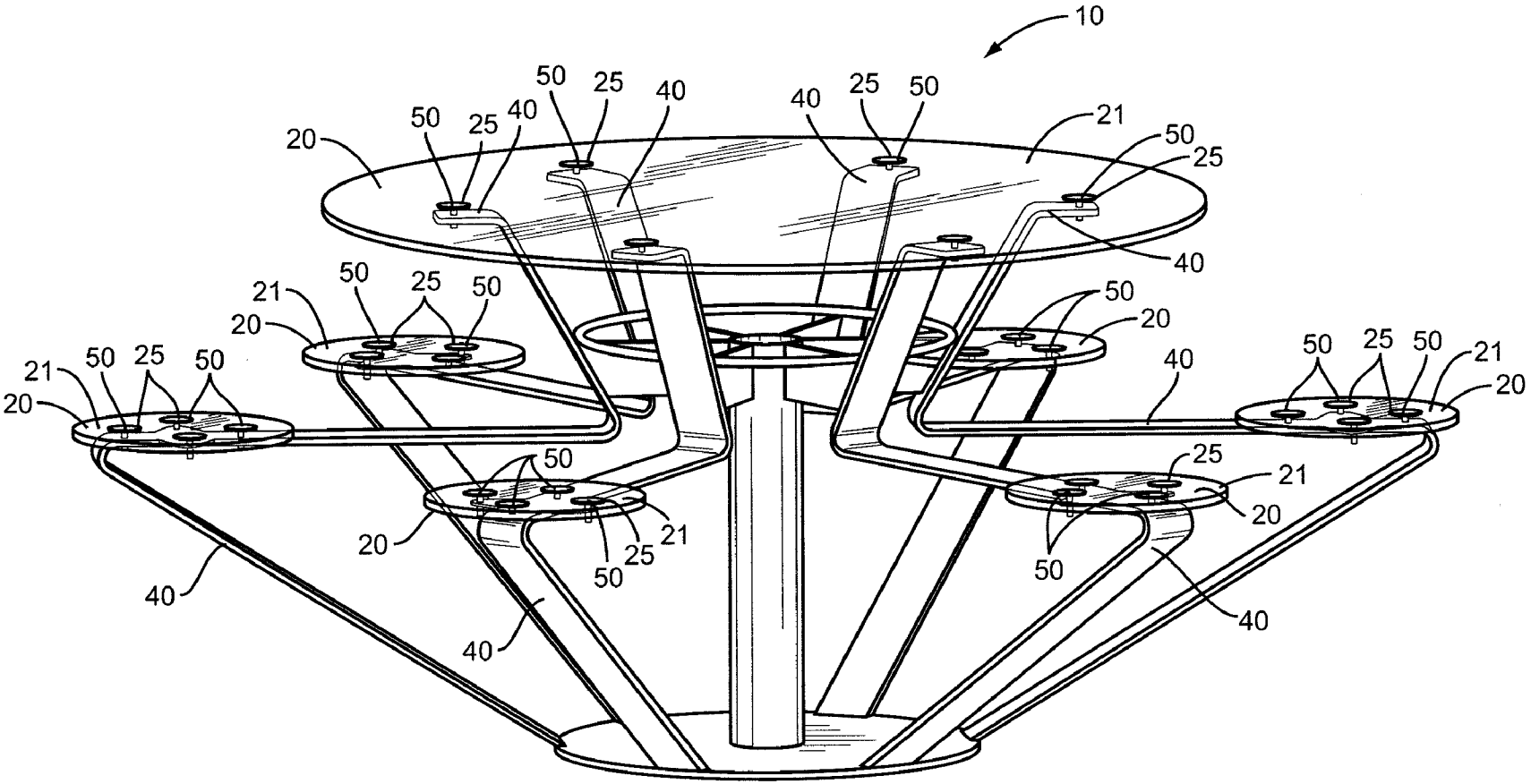
FIG. 2 is a perspective view of a furniture piece with recessed fasteners according to one embodiment.

FIGS. 1 and 2 each illustrate an embodiment of a furniture piece 10 that includes a combination of a table and chairs. The furniture piece 10 includes a first set of fasteners 50 that attaches a table top support member 20 to braces 40 and a second set of fasteners 50 that attaches seat support members 20 to braces 40. The fasteners 50 are positioned in recesses 25 in the support members 20. This structure positions a top of the fasteners 50 flush with a top surface 21 of the support member 20, or recessed inward below the top surface 21 of the support member 20. This positioning makes the furniture piece 10 more user-friendly as items such as plate, books, paper, etc. should not snag on the fasteners 50 in the table top support member 20, and clothing should not snag on the fasteners 50 in the seat support members 20. The positioning may also prevent tampering with the fasteners 50 in an attempt to remove them from the furniture piece 10.

The embodiments of FIGS. 1 and 2 each include both the table and the chairs with fasteners 50 that are seated within recesses 25 in the corresponding support members 20. Other furniture pieces 10 with combinations of two or more elements may include just one of the elements including this aspect.

Figure 3:
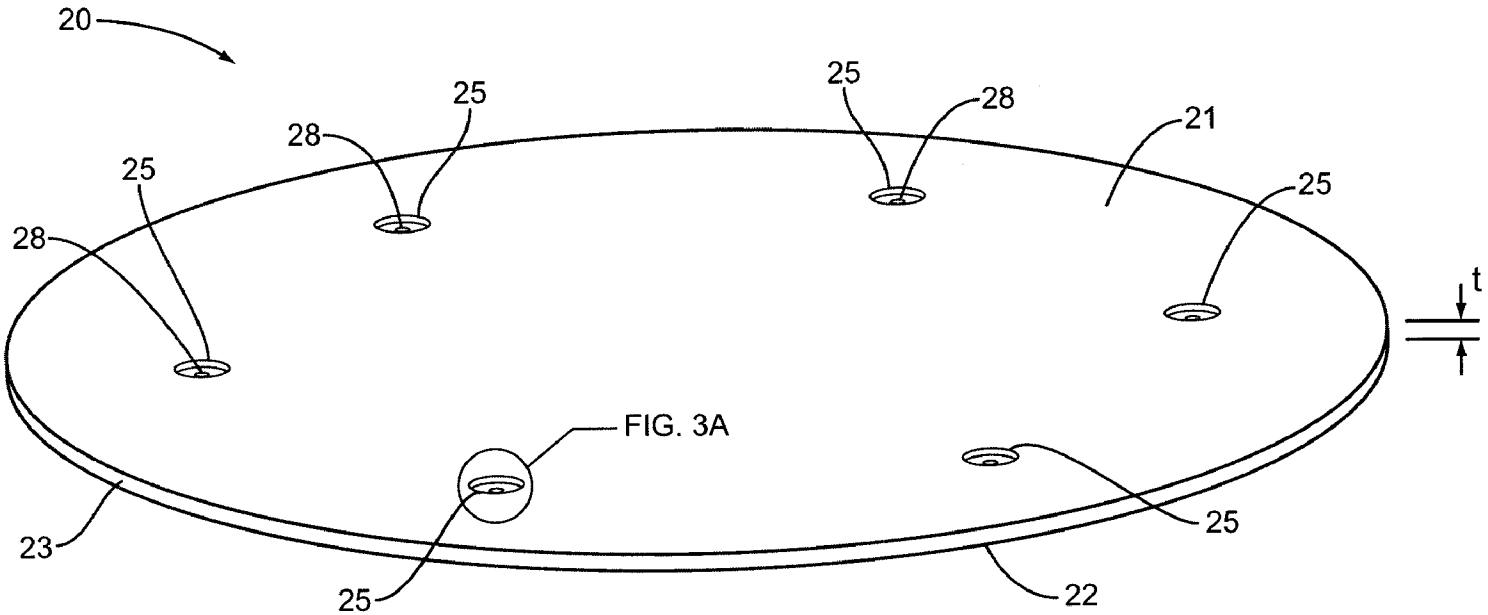
FIG. 3 is a perspective view of a support member according to one embodiment.

The support member 20 provides a support surface for performing a variety of different activities such as forming a work surface for a table or a seat for a chair, stool, or bench. As illustrated in FIG. 3, the support member 20 includes a top surface 21 and a bottom surface 22. The top surface 21 is normally flat, although it may also be curved or include two or more sections at different angular positions. The bottom surface 22 may be the same or different than the top surface 21. FIG. 3 includes each of the surfaces 21, 22 being substantially flat and parallel to each other. The support member 20 includes a thickness t measured between the surfaces 21, 22.

A sidewall 23 extends between the surfaces 21, 22 and may include various shapes. FIGS. 1 and 2 each illustrate support members 20 with a round shape. Although a round shape is often used in correctional institutions, the support members 20 may also include a variety of other shapes.

Figure 3A:
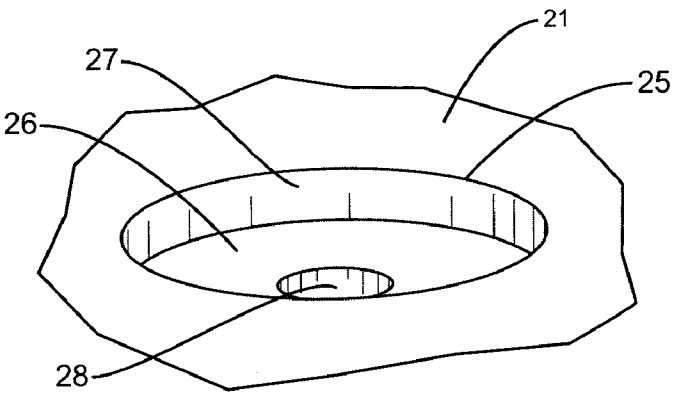
FIG. 3A is a magnified view of the section of FIG. 3 illustrating a recess according to one embodiment.

A recess 25 extends into the top surface 21 to receive the fastener 50. The depth of the recess 25 may vary depending upon the size of the fastener 50, but is less than the thickness of the support member 20. In one embodiment, the depth is about 3/16". The depth may vary depending upon the thickness of the support member 20 and the fastener 50. FIG. 3A includes an exploded view of the recess 25 highlighted in FIG. 3. The recess 25 includes a bottom surface 26 and a sidewall 27. The bottom surface 26 may be flat, may be curved, or may include two or more sections at different angular orientations. FIG. 3A includes the bottom surface 26 being flat and substantially parallel with the top surface 21. The recess 25 may include a variety of shapes, including circular as illustrated in FIG. 3A.

An aperture 28 extends through the support member 20 to accommodate the fastener 50. The aperture 28 extends from the bottom 26 of the recess 25 through to the bottom side 22. The aperture 28 may be centered in the bottom surface 26 of the recess 25, or may be offset within the recess 25. The width of the aperture 28 and the shape may vary. The aperture 28 may also be threaded to thread with the fastener 50.

The support member 20 should be strong enough to allow for the various functions. The support member 20 may be constructed from a variety of materials including but not limited to polycarbonates such as LEXAN, acrylics, plastics, fiberglass, KEVLAR, carbon fiber, metals, and composites.

The support member 20 may be light-transmissive. This aspect is particularly useful in a correctional institution because it permits visual observation of the area underneath and around the furniture piece 10. The light-transmissive support member 20 allows institution personnel to conduct visual inspections. Furthermore, given appropriate lighting conditions, this visual inspection may be conducted from a safe distance, for instance beyond the room or cell in which the furniture piece 10 is located. Similarly, visual inspection may be conducted with the aid of a surveillance camera so as to preserve the safety of institution personnel or other inmates. The term "light transmissive" should be understood to represent that characteristic of a medium that permits the transmission of electromagnetic radiation in the visible spectrum so as to enable one to visually distinguish an object through the medium. The term light-transmissive encompasses, but is not intended to be limited to, the terms translucent and transparent.

Figure 4:
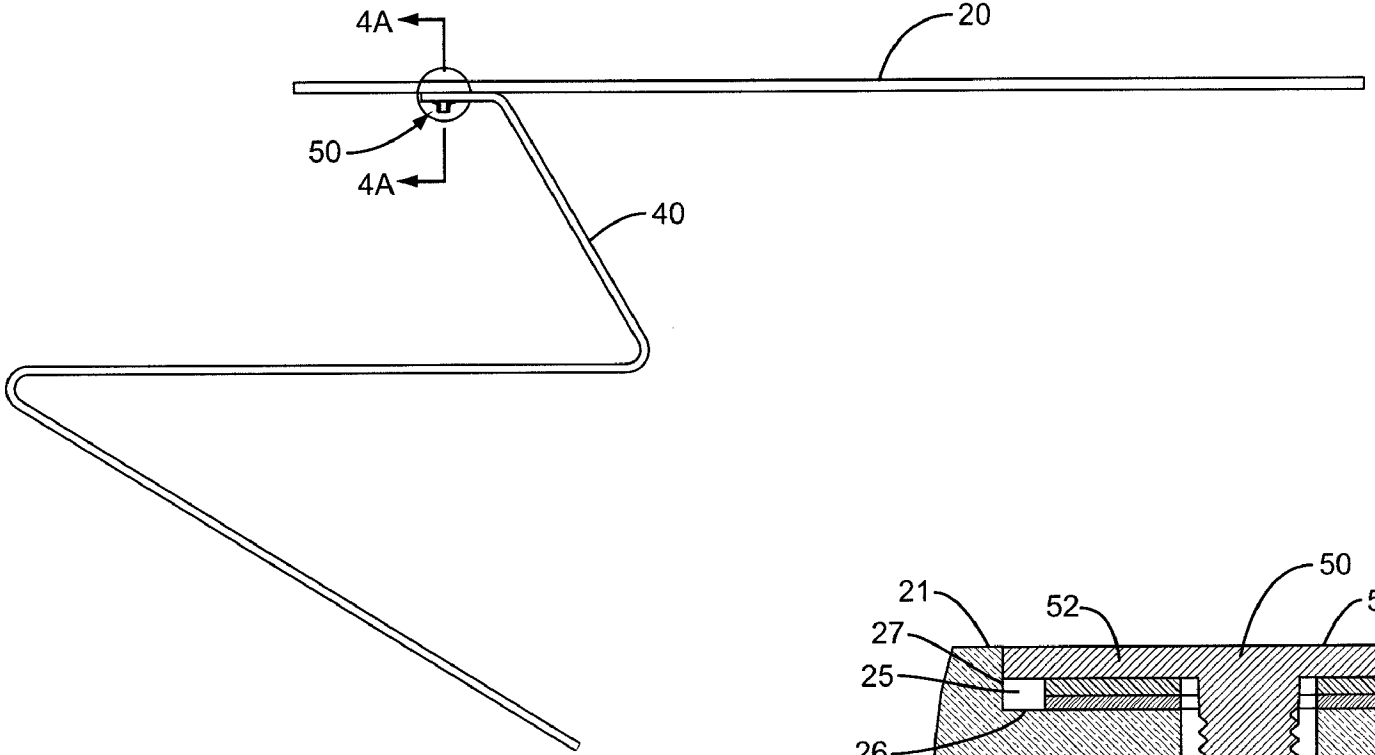
FIG. 4 is a side view of a fastener assembly attaching together a support member and braces according to one embodiment.
Figure 4A:
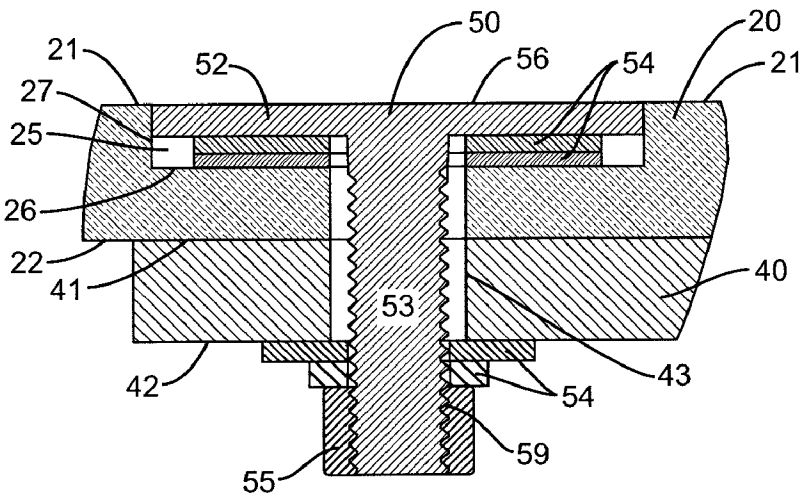
FIG. 4A is a sectional view along line 4A-4A of FIG. 4.

The brace 40 is attached to and supports the support member 20. As best illustrated in FIGS. 4 and 4A, the brace 40 includes a top surface 41 and a bottom surface 42. A thickness of the brace 40 measured between these surfaces 41, 42 may vary. FIGS. 4 and 4A include each of the surfaces 41, 42 being parallel and substantially flat. In one embodiment as illustrated in FIG. 2, the brace 40 is constructed from flat bar.

The top surface 41 of the brace 40 may include the same configuration as the bottom surface 26 of the support member 20. One example is illustrated in FIG. 4A with each surface 41, 26 being the same. This provides good contact between the members 20, 40. In some embodiments, the members 20, 40 do not directly contact each other but are spaced apart by one or more intermediate members (not illustrated). The intermediate members may space the members 20, 40 various distances apart.

The brace 40 may include an aperture 43 that extends between the top and bottom surfaces 41, 42. The aperture 43 is sized to accommodate the fastener 50 as illustrated in FIG. 4A. The size and shape of the aperture 43 may vary. In one embodiment, the aperture 43 is threaded.

In another embodiment, the brace 40 includes a cavity that extends a limited distance into the top surface 41. The cavity does not extend through the brace 40, but rather terminates at a depth somewhere between the top and bottom surfaces 41, 42. The cavity is sized to receive the fastener 50 in a similar manner as the aperture 43, and may be threaded to engage with the fastener 50.

Figure 5:
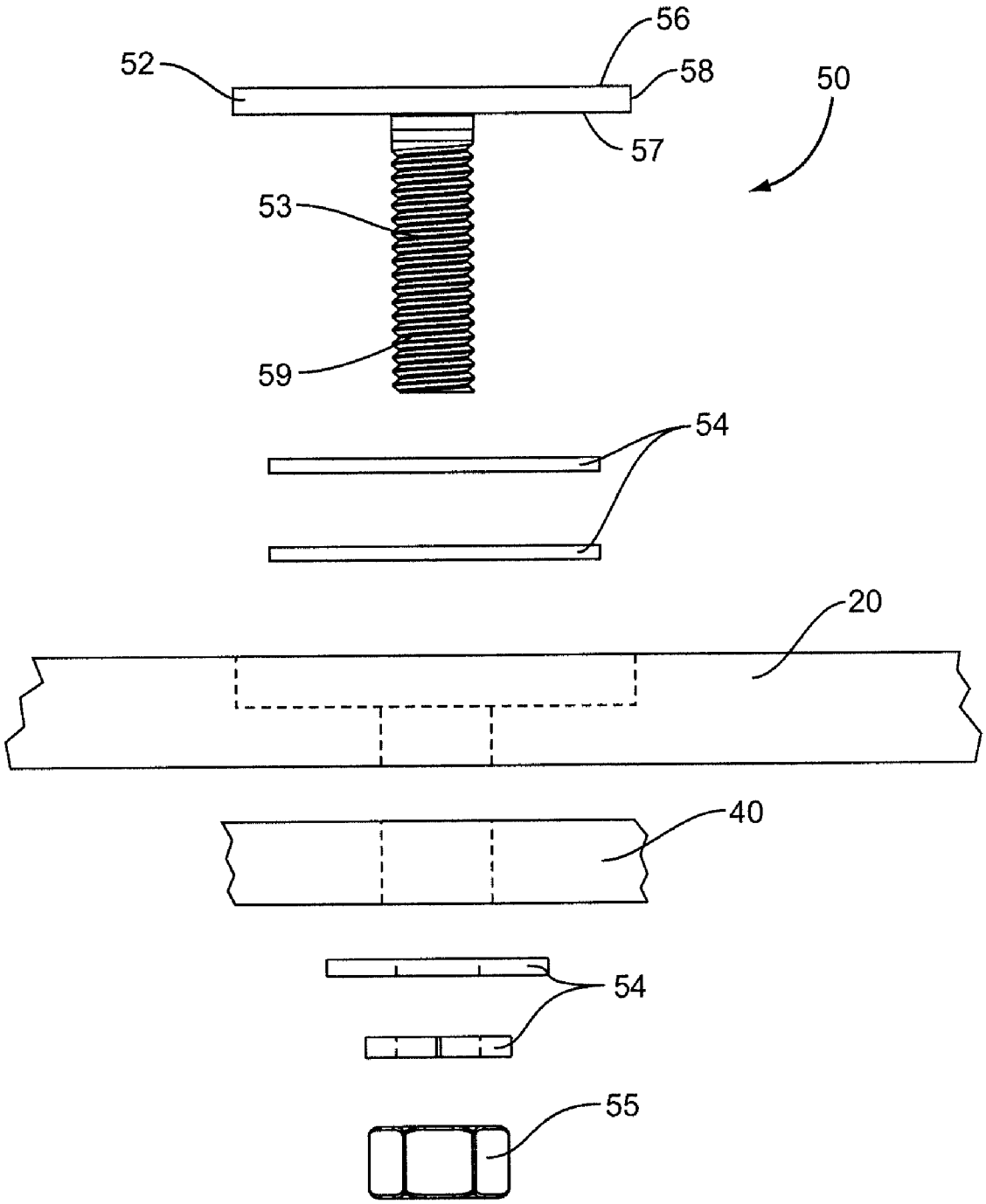
FIG. 5 is an exploded view of a fastener assembly, a support member and braces according to one embodiment.

The fastener 50 extends into the support member 20 and brace 40. FIG. 5 illustrates that the fastener 50 includes an enlarged head 52 and an outwardly-extending neck 53. Examples of the fastener 50 include bolts, rivets, and screws.

The head 52 includes a top surface 56, bottom surface 57, and an intermediate sidewall 58. The surfaces 56, 57 may be the same or different. FIG. 5 includes the surfaces 56, 57 each being substantially flat and parallel. Other embodiments include the surface 56 with a curved convex shape. The head 52 includes a thickness measured between the surfaces 56, 57. The thickness may be equal to or less than the depth of the recess 25. This sizing provides for the top surface 56 to be positioned flush with or below the top surface 21 of the support member 20 when the fastener 50 attaches the first and support member 20 and brace 40.

The shape and size of the head 52 may match the recess 25. The head 52 may seat in the recess 25 with little to no gap formed between the recess sidewall 27 and the head sidewall 58. This sizing prevents items (e.g., food crumbs, paper) from falling between the sidewalls 27, 58 and being difficult to remove. Further, this sizing makes it difficult for a user to tamper with the fastener 50. In one specific embodiment, the head 52 is sized with the sidewall 58 contacting against the recess sidewall 27.

The neck 53 extends outward from the head 52 and includes a length to extend into the first aperture 28 and the second aperture 43. The neck 53 may be threaded with the threads 59 extending the entire length, or extending along a limited section. FIGS. 4A and 5 include embodiments with the threads 59 extending substantially the entire length of the neck 53.

The nut 55 includes a threaded central aperture sized to receive the neck 53. The nut 55 may include a locking feature that prevents the nut 55 from being removed from the neck 53. The locking feature may include an adhesive, solder, or mechanical structure that prevents removal. This is of importance when the furniture piece 10 is used in a correctional institution.

One or more spacers 54 may be positioned between the head 52 and the nut 55. The spacers 54 are generally thin plates with an aperture that extends around the neck 53. The spacers 54 may function to distribute the load of the fastener 50 over the support member 20 and brace 40. The spacers 54 may also provide height adjustment to position the top surface 56 of the head 52 relative to the top surface 21 of the support member 20. The spacers 54 positioned between the head 52 and the support member 20 may also reduce vibration or movement between the support member 20 and the fastener 50. The spacers 54 may be constructed from a variety of material including but not limited to metals, rubbers, silicones, and plastics. In furniture pieces 10 with multiple spacers 54, the spacers 54 may include the same or different construction, size, and shape. FIG. 4A includes an embodiment with each of the spacers 54 positioned between the head 52 and the support member 20 being constructed from a compressible material, and spacers 54 positioned between the nut 55 and the brace 40 being constructed from a non-compressible material. The spacers 54 may be constructed from a compressible material to adjust the position of the top surface 56 relative to the top 21 of the support member 20 based on the amount of torque applied to the fastener 50 and nut 55.

During construction, the support member 20 and brace 40 are positioned to align the respective apertures 28, 43. One or more spacers 54 are positioned accordingly and the fastener 50 is inserted through the apertures 28, 43. The nut 55 is threaded onto the end of the neck 53 to attach the support member 20 and brace 40 together. The amount of torque applied to the nut 55 and fastener 50 can be used to adjust the height of the fastener 50. Using FIG. 4A as an example, a first amount of torque may be applied that positions the top 56 of the head 52 flush with the top 21 of the support member 20. Additional torque may compress the spacers 54 resulting in the top 56 of the head 52 moving into the recess 25 and below the top 21 of the support member 20.

Furniture pieces 10 may include various numbers of fasteners 50 to attach the support member 20 to the brace 40. FIG. 1 includes a pair of fasteners 50 attaching each seat support member 20 to the corresponding brace 40. FIG. 2 includes four fasteners 50 per seat support member 20. Other embodiments may include more or less fasteners 50 to attach the support member 20.

Figure 6:
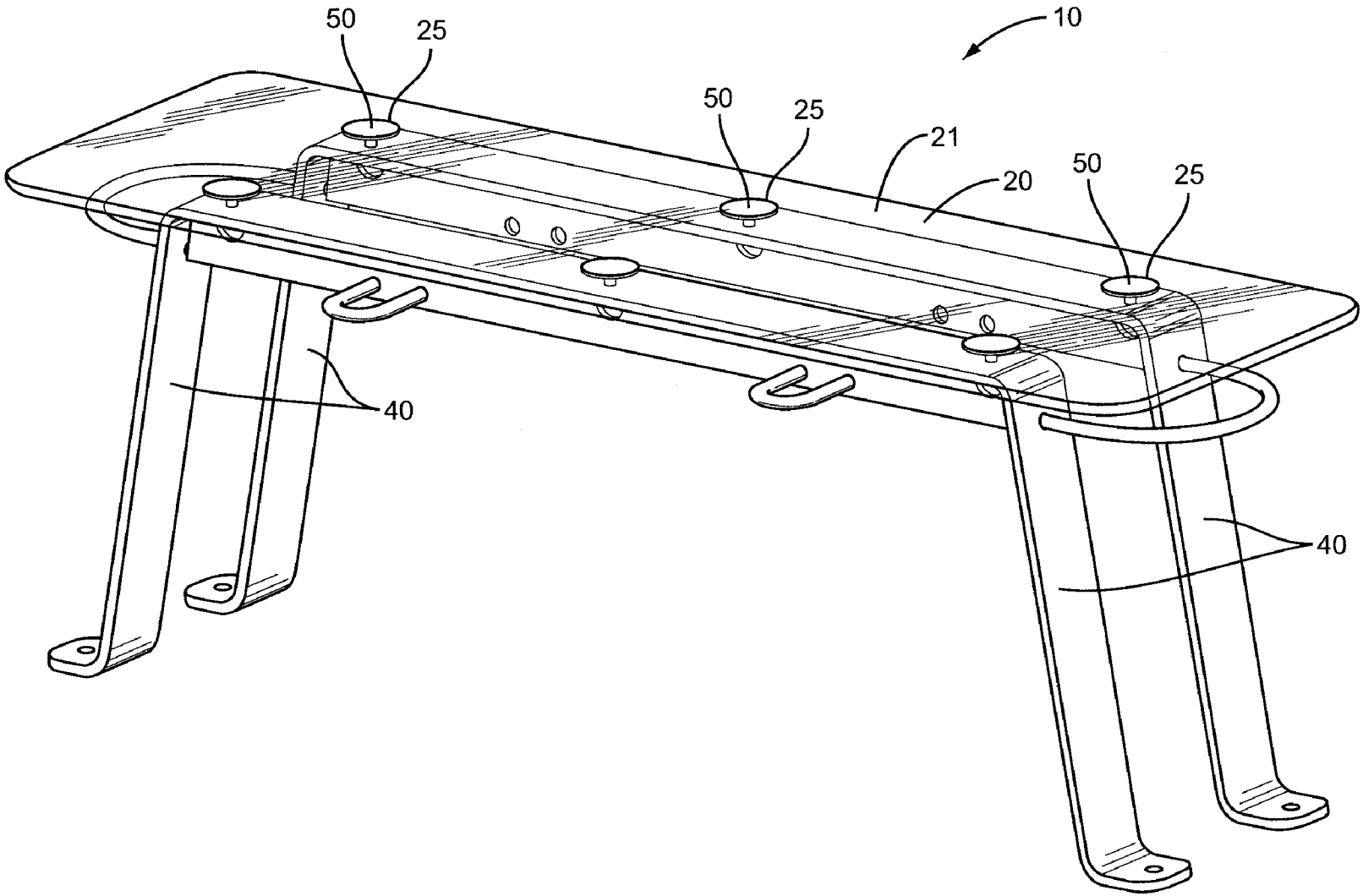
FIG. 6 is a perspective view of a furniture piece according to one embodiment.

FIGS. 1 and 2 include furniture pieces 10 that include a combination of tables and seats. FIG. 6 is a furniture piece 10 that includes just a seat. Specifically, the seat is a bench with an elongated support member 20 that can be used by multiple users. The furniture pieces 10 may also include a variety of other tables and seats and combinations.

The furniture pieces 10 are constructed and designed for use in a variety of different contexts. One context is for use at correctional institutions where safety is a major concern. The furniture pieces 10 may also be used for other purposes, such as home and office use.

Spatially relative terms such as "top", "bottom", "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A furniture piece comprising:

a support member constructed from a light-transmissive material and including a thickness formed between a first surface and an opposing second surface, the support member including a recess formed into the first surface with a depth less than the thickness, the support member also including a first aperture within the recess that extends through to the second surface;

a brace positioned to support the support member, the brace including a second aperture that aligns with the first aperture;

a fastener with a head that fits within the recess and an outwardly-extending neck that extends through the first and second apertures;

a nut that attaches to a section of the neck that extends outward from the second aperture;

a spacer positioned above the nut and along the neck and including a central aperture that receives the neck, the spacer being non-integral with the nut;

a height of the head being less than the depth of the recess such that a surface of the head is flush with the first surface of the support member or positioned within the recess below the first surface of the support member.

2. The furniture piece of claim 1, wherein the support member contacts directly against the brace.

3. The furniture piece of claim 1, wherein the head and the recess include a common shape and the head contacts against a sidewall of the recess.

4. The furniture piece of claim 1, wherein the support member is constructed from a polycarbonate material.

5. The furniture piece of claim 1, wherein the spacer is positioned between the head and a bottom of the recess, and a second spacer is positioned between the nut and the brace.

6. The furniture piece of claim 1, wherein the support member is a table top and the brace is a brace that supports the table top.

7. A furniture piece comprising:

a top member including a first surface and a second surface, the top member including a recess formed into the first surface with a depth less than a thickness of the top member and the recess including a bottom surface, the top member also including a first aperture that extends through the top member between the recess and the second surface;

a bottom member positioned to support the top member and including a second aperture that aligns with the first aperture;

a fastener with a head that fits within the recess and a neck that extends outward from the head and includes a length to extend through the first and second apertures, the head including a greater width than the neck and including a height less than the depth of the recess; and a spacer that extends around the neck and includes first and second surfaces, the spacer positioned between the head and the bottom surface of the recess to space the head relative to the first surface of the top member.

8. The furniture piece of claim 7, wherein the top member is a seat support member.

9. The furniture piece of claim 7, wherein the head and the recess include a common width for the head to contact against a sidewall of the recess.

10. The furniture piece of claim 7, wherein the second surface of the top member and a first surface of the bottom member are flat and directly contact together.

11. The furniture piece of claim 7, wherein the top member is light-transmissive.

12. A furniture piece comprising:

a light-transmissive table top with a top surface and a bottom surface, the table top including a recess extending into the top surface with a depth measured between a bottom of the recess and the top surface being less than a thickness of the table top measured between the top and bottom surfaces, the table top also including a first aperture that extends through the table top between the bottom of the recess and the bottom surface;

a brace positioned below the table top to support the table top, the brace including a second aperture that aligns with the first aperture;

a fastener with an enlarged head and an outwardly-extending neck, the head being positioned in the recess and the neck positioned through the first and second apertures, the head including a first surface that faces away from the bottom of the recess and a second surface that faces towards the bottom of the recess and including a height measured between the first and second surfaces that is less than the depth of the recess; and a spacer that extends around the neck and is positioned between the head and the bottom of the recess to position the first surface of the head relative to the top surface of the table top, the spacer including a thickness to position the first surface flush with the top surface of the table top or within the recess and below the top surface.

13. The furniture piece of claim 12, further comprising a light-transmissive seat support member positioned adjacent to the table top.

14. The furniture piece of claim 13, wherein the seat support member is attached to the brace.

15. The furniture piece of claim 13, wherein the top surface of the table top is flat and a top surface of the seat support member is flat with the surfaces being parallel.

16. The furniture piece of claim 12, wherein the brace directly contacts against the bottom surface of the table top.

17. The furniture piece of claim 12, further comprising a connector that engages with a section of the neck that extends outward beyond the second aperture of the brace.

18. The furniture piece of claim 12, wherein the head and the recess include a common width for the head to contact against a sidewall of the recess.

19. The furniture piece of claim 18, wherein the head and the recess each include a circular shape.

20. The furniture piece of claim 12, wherein the table top is constructed from a polycarbonate material.

* * * * *